United States Patent [19]

Morita et al.

[11] Patent Number: 4,954,844

[45] Date of Patent: Sep. 4, 1990

[54] MULTICOLOR IMAGE DEVELOPING DEVICE

[75] Inventors: Shizuo Morita; Toru Matsumoto; Masayuki Kamegamori; Kazushi Hayakawa; Noboru Hatakeyama; Shunji Matsuo; Masakazu Fukuchi, all of Tokyo, Japan

[73] Assignee: Konica Corporation, Tokyo, Japan

[21] Appl. No.: 283,607

[22] Filed: Dec. 13, 1988

[30] Foreign Application Priority Data

Dec. 17, 1987 [JP] Japan ..... 62-320596
Dec. 17, 1987 [JP] Japan ..... 62-320597
Dec. 26, 1987 [JP] Japan ..... 62-331227

[51] Int. Cl.[5] ..... G03G 15/01; G03G 15/08

[52] U.S. Cl. ..... 355/260; 355/245; 355/326; 355/327

[58] Field of Search ..... 355/260, 245, 326, 327, 355/251, 253, 211

[56] References Cited

U.S. PATENT DOCUMENTS 4,591,258 5/1986 Nishino et al. ..... 355/211 X
4,598,993 7/1986 Mizutani et al. ..... 355/211
4,647,180 3/1987 Watanabe ..... 355/260 X
4,699,494 10/1987 Honda ..... 355/211
4,746,951 5/1988 Hayakawa et al. ..... 355/245
4,841,329 6/1989 Kasamura et al. ..... 355/245
4,845,523 7/1989 Miyaji ..... 355/260 X

*Primary Examiner*—A. C. Prescott
*Attorney, Agent, or Firm*—Jordan B. Bierman

[57] ABSTRACT

Disclosed is an apparatus for forming a color image on a photoreceptor, in which along the rotation direction of the photoreceptor there are provided an imagewise exposure process to form a latent image, a development process including a plurality of developing devices to form a color toner image, each of the plural developing devices having a toner hopper, and a transfer process to transfer the formed color toner image onto a copy paper. The apparatus comprises a housing for including at least the photoreceptor, the plural developing devices and the plural toner hopper as one unit, and a support guide for supporting the housing to be movable in the axial direction of the photoreceptor so that the unit is attached to and detached from the apparatus.

10 Claims, 11 Drawing Sheets

FIG. 2-a
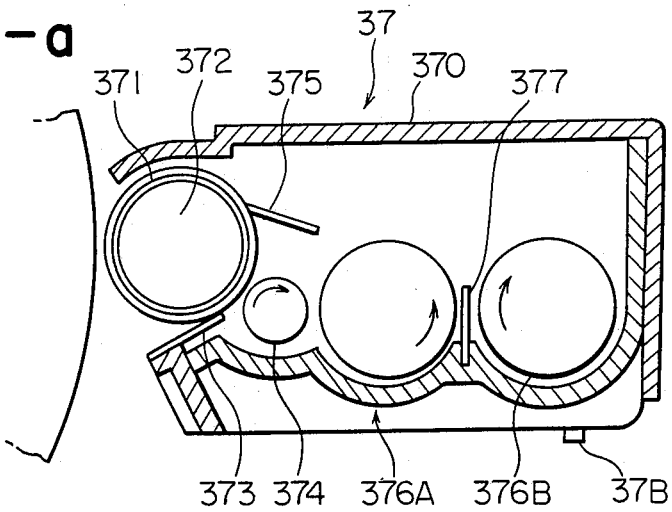
FIG. 2-b
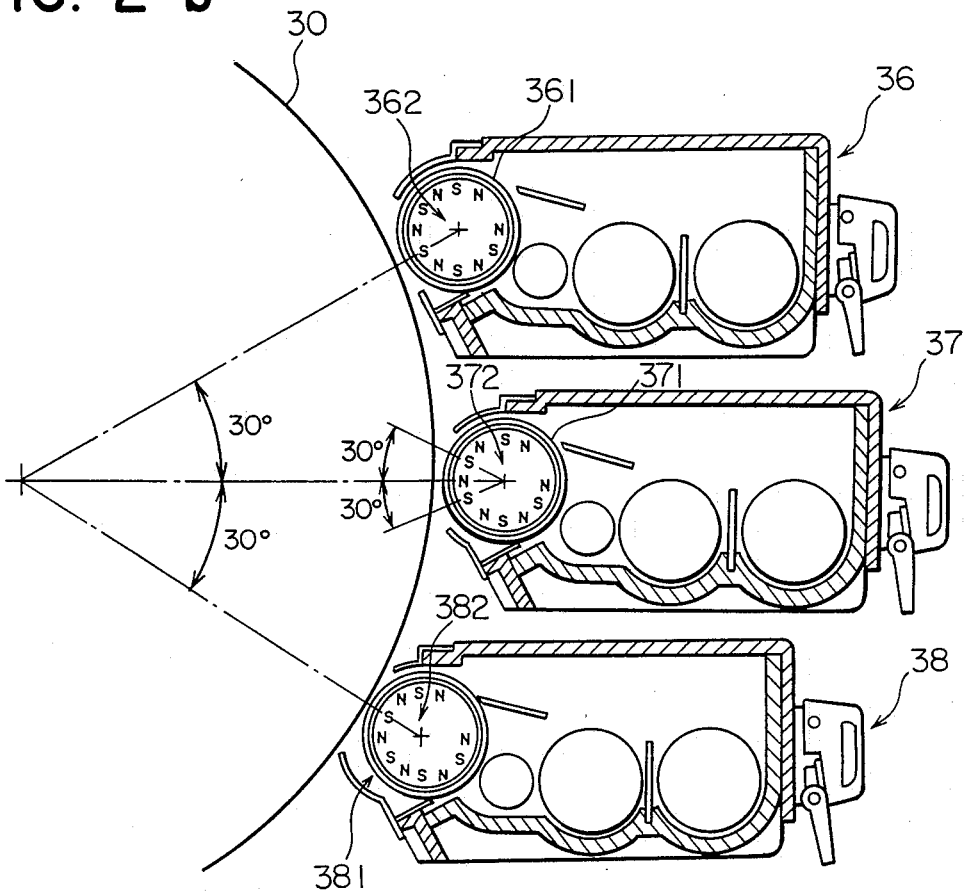

MULTICOLOR IMAGE DEVELOPING DEVICE

BACKGROUND OF THE INVENTION

This invention relates to a multicolor image developing device to develop a latent image formed on a light-sensitive drum, an image carrier, by a plurality of developing means containing respective color developing agent to obtain color copies by an electrophotographic method.

Many methods and devices have been proposed to obtain a color image using electrophotographic methods. For instance, as disclosed in the official bulletin of Japanese Patent Publication Open to Public Inspection No. 100770/1986 (hereinafter referred to as Japanese Patent 0.P.I. Publication), there is a method to obtain color copies by forming and developing latent images on a light-sensitive drum according to number of separated colors of the original copy image, transferring them to a transfer drum every time of development to form a multiple color image on the transfer drum, and then transferring it on recording paper to obtain color copies. Devices using this method should have a transfer drum which is sized to enable to transfer an image of one sheet on its periphery surface in addition to the light-sensitive drum and therefore the device becomes inevitably large in size and complicated in structure.

There is another method of obtaining multiple color copies by forming and developing latent images on a light-sensitive drum according to the number of separated colors of the original copy image and transferring them on a transfer material every time of developing to obtain multiple color copies as disclosed in the official bulletin of Japanese Patent 0.P.I. Publication No. 149972/1986. It is difficult by this method to place one color image upon another with high accuracy and high quality color copies cannot be obtained.

There is another method of obtaining a color image by repeating formation of a latent image and development with color toner on a light-sensitive drum according to the number of separated colors of the original copy image, placing a color toner over another color toner image, and then transferring them onto a copy paper.

This basic multiple color image forming process has been disclosed in the official bulletin of Japanese Patent 0.P.I. Publication Nos. 75850/1985, 76766/1985, 95456/1985, 158475/1985, and others by the applicant of this invention.

In such multicolor image developing devices which obtain a color image by superimposing a color toner upon another color toner image, multiple developing devices containing toner of different colors are arranged on the periphery of a light-sensitive drum and generally the light-sensitive drum is rotated several turns to develop the latent image on it and obtain a color image.

In this case, the light sensitive drum should have a circumference longer at least than a length of the original document. For instance, for the maximum recording body of the B4 form (364×257/mm), the drum diameter should be about 130 mmϕ including the allowance required in the image forming process.

According to the study by the applicant of this invention, as described in details in the specification of Japanese Patent 0.P.I. Publication No. 229165/1987, since the latent image written by a writing means on the light-sensitive drum is transferred after a developed image is placed one upon another, a cleaning means should be separated from the light-sensitive drum periphery surface during image formation and the cleaning means is brought in sliding contact with the light-sensitive drum periphery surface only after the transfer process. At this time, it gives influence on the rotation of the light-sensitive drum and if writing by the writing means is being continued at this time, images to be placed upon another are deviated and the image quality is deteriorated. Therefore, the light sensitive drum diameter should be sized with sufficient allowance. The same is applicable to development. Developing by the multiple developing means provided on the periphery of the light-sensitive drum applying developing bias at the same time causes a difference from the point where the independent developing means conducts development and is undesirable. The size of the image carrier drum is determined based on these conditions and a large diameter drum is required as described above. In multicolor image developing devices in which color images are placed upon one another on a light-sensitive drum, such developing means which conduct development with a traditional magnetic brush in contact with an image carrier cannot be used. The applicant of this invention made it possible to provide a multicolor image developing device in which toner images are placed upon one another on an image carrier using the non-contact developing method which was disclosed in the official bulletin of Japanese Patent 0.P.I. Publication No. 147652/1982 and others. As for general duplicators, it is proposed to install a light-sensitive drum, developing equipment and cleaner integrally to a supporting member to facilitate substitution, repair, etc. of each unit as disclosed in the official bulletin of Japanese Patent 0.P.I. Publication No. 54392/1983. To cope with monochrome, a disposable composition unifying them in one unit for easy replacement is disclosed in the official bulletin of Japanese Patent 0.P.I. Publication No. 154255/1982. However, none improve them to cope with multiple color image developing devices which have multi color or full color developing devices, improving the maintenance or working efficiency.

When multiple developing devices are arranged on the periphery of a light-sensitive drum, toner is dispersed more in the equipment rather than in general duplicating machines and service, maintenance, and other jobs should be conducted more often.

However, in multicolor image developing devices in which toner images are placed upon one another on an image carrier as described above, the equipment is complicated and large in size, especially in multiple developing devices which keep highly accurate gap dimensions to the light sensitive drum surface respectively, and handling multiple developing devices is complicated. Thus expecting easier service, maintenance, and other jobs is almost impossible.

Especially in developing devices using a 2-component type developing agent, change of developing agent, cleaning of dispersed toner, and other indispensable maintenance treatment are required unless they are of the disposable type. In addition, cleaning and replacement of the density sensor, cleaning of the bias contact point or armature, and other various maintenance jobs are necessary. Especially handling multiple developing devices in order to form color images makes such maintenance jobs more complicated. Any method to make them easier has not been provided.

In summary, the following problems can be cited:

(1) In the color image forming apparatus, described above, such as overlapping color image and other multiple color image developing devices, an arrangement, form or other conditions of an individual developing device vary depending on the structure of equipment, which caused problems such that the light-sensitive body is damaged when it is substituted or the developing device is pulled out to change the developing agent. In another case, in order to solve the problem that toner image on a light-sensitive body after being developed in a certain color may be scraped by a developing device of another color toner and resultantly the toner image is disturbed or the colors were mixed, each developing device should have had a touching and separating mechanism. In addition, there were mechanical and time problems such as switching of bias, etc. Their structure is complicated, multiple units should be handled for operation and maintenance requiring complicated jobs, a large number of parts are required, and resultantly there is a tendency that reliability is inferior.

(2) On the other hand, there are various methods to conduct development at a same point by turning a developing device disposed at a specified position of a rotatable body by a specified angle for each developing color, which is known as a rotary developing device. These methods are difficult to obtain positioning accuracy during the rotating operation. Especially in the case of non-contact development, the positioning mechanism for the gap (Dsd) between the image carrier and developing agent carrier is complicated and accuracy is difficult to obtain or speed-up is difficult due to the time restriction required for rotation, and there are various other problems.

(3) In addition, variation of developing characteristics due to variation of Dsd caused by the variation of the drum diameter resulting from changes in the temperature within the machine or variation of Dsd caused by influence of internal or external vibration, impact, etc. causes deterioration of image quality conjointly with the size of the light-sensitive drum. Actually, variation of Dsd requires accuracy of about '0.02–0.03 mm, while rotating eccentricity of the drum central axis is usually about ±0.005–0.01 and the gap between the drum surface after being installed to the equipment main body and developing device varies about ±0.1–0.3 mm. Also expansion and contraction of about ±0.01–0.02 mm is caused in a current drum made of aluminum as the major material due to variation of temperature in the machine when the equipment is used in a temperature of 5–35° C.

Along with the electric potential variation at the time of development as described above in (2), color mixture, color balance and other adverse influences are given to the image quality.

Other major problems which this invention intends to solve are as follows:

In the developing devices described above, replenishing hoppers to replenish toner respectively are often incorporated on the side of the group of developing devices in the equipment main body usually and therefore each developing device and corresponding replenishing hopper should be connected within the confined space. For the purpose of supplementing toner to replenishing hopper, an opening door or the like to insert a developing agent cartridge should be specifically provided on the top or side of the equipment main body. Thus, disadvantages such as high manufacturing cost and complicated handling for users were unavoidable. Especially, if realizing an in image developing devices which are composed so that the group of the developing devices are installed integrally together with an image carrier to a supporting member or a housing member which can be pulled out, the group of the developing devices can be removed easily from the equipment main body by pulling out the supporting member for very simplified maintenance and inspection, however, if the group of the replenishing hoppers should be removed individually from the equipment main body independently of the group of developing devices, their maintenance and inspections are not easy.

An object of this invention is to provide a multicolor image developing device which is composed so that the group of replenishing hoppers are installed within space with allowance and the group of the replenishing hoppers can be also removed from the equipment main body at the same time as pulling out of the supporting member housing the developing devices and the image carrier therein. When installing a replenishing hopper to the supporting member, it is the most rational to install it to the front of the supporting member from the view point of the necessity of securing sufficient large capacity, layout of the connecting mechanism, or installation and operation of the developing agent cartridge. For this reason, replenishing hoppers containing a specific color of toner respectively are provided in a row in the lateral direction on the front of the supporting member and each replenishing hopper vessel is square shorter in the longitudinal direction and slightly longer in the lateral direction in many cases for the purpose of making the depth of the equipment main body compact. Therefore, because of the vessel shape, the opening/closing door of the toner replenishing port will be unavoidably opened in the lateral direction and resultantly the vessel of another adjacent replenishing hopper interferes with it in some cases.

Especially in image developing devices of the type to incline the replenishing hopper at a certain angle frontward when replenishing toner, opening or closing the lid in the longitudinal direction is impossible. The second object of this invention is to provide an image developing device which can open or close the replenishing port without being hindered by an adjacent replenishing hopper and can replenish toner easily by installing a developing agent cartridge to each replenishing hopper arranged in a row in the lateral direction, as the result of having solved and improved this point.

SUMMARY OF THE INVENTION

The above objects are attained by a multicolor image developing device comprising an image carrier, electricity charging means to give electric charge to said image carrier, exposure means to expose an image on the said charged image carrier according to multiple color image information, multiple developing means to develop an electrostatic latent image formed on the image carrier described above by the exposure means, transfer means to transfer the toner image obtained by the development, cleaning means to clean the toner remaining on the above described image carrier after the transfer, and multiple replenishing means to replenish toner to the above described multiple developing means in the main body of the equipment, in which at least the above described image carrier and above described group of multiple developing means are installed to the equipment main body integrally with a detachable supporting member for housing the image carrier and the multiple developing means in one unit so that unit can be pulled out, and the above described multiple replenishing means corresponding to the above described multiple developing means is mounted on the front of the said supporting member.

The above object can be attained also by installing at least the above described image carrier and above described group of multiple developing means to the equipment main body integrally with a supporting member which can be pulled out and installing the above described multiple replenishing means corresponding to the above described multiple developing means integrally to a rotatable opening/closing member held to the front of the said supporting member.

In this invention, the multiple developing devices are composed of compact and thin developing devices that are separated from replenishing means and can obtain good image quality without giving influence on the image quality, designing the main part of housing for the developing device to be usable in common for at least more than 2 developing devices, and more actually disposing compact and thin developing devices by piling them horizontally (in parallel with) to the light-sensitive drum axis, desirably restricting the height of the piled multiple developing devices within the drum outside diameter, and installing image carrier and multiple developing devices to the equipment main body integrally with a supporting member which can be pulled out thereby enabling each developing device and image carrier to be removed easily from the equipment main body, and thereby facilitating maintenance and inspections. That is;

(1) Operation and maintenance become remarkably simple since complicated arrangement of developing devices is eliminated and they are arranged in a horizontal pile, and at least more than 2 developing devices are used in common. In addition, since the piled and horizontally arranged developing devices can be pulled out in parallel with each other at the time of maintenance, mechanism and operation becomes simpler. This is effective since multiple developing devices are installed integrally to the supporting member and can be respectively pulled out horizontally (in parallel with the drum pulling out direction) simply by pulling out the supporting member frontward, and both the drum and the developing units can be pulled out by one-touch operation. In addition, not only the mechanism and structure can be simple and maintenance and operation become easier, but also cost reduction can be realized by rationalizing these multiple structures (developing devices) making them common and compact, thereby making parts more simple, similar, and common, leading to reduction of the number of parts and improvement of reliability.

(2) By the above composition, the gap between adjacent developing devices can be approximately even and smaller with respect to the light-sensitive drum rotating direction and the distance from the charge and exposure operating position to each developing device can be shorter and therefore the influence of difference in the electric potential damping amount due to positions of the developing devices can be restrained. Also it was intended to reduce influence of vibration and impact by suspending the integral structure with the supporting member to the equipment main body and improve the image quality including prevention of deterioration of Dsd in non-contact development of multiple-rotation overlapping image formation especially.

(3) In order to solve the above problems, according to this invention, a group of multiple developing devices are composed of compact and thin developing devices which separate from replenishing hoppers and can obtain good image quality without giving influence on the image property, a major part of the housing for developing device is structured to incorporate at least more than 2 of the developing devices, actually compact and thin developing devices are arranged by placing one upon another horizontally and in parallel to the image carrier axis, desirably within the drum diameter of the image carrier. Image carrier and multiple developing devices are integrally installed to the supporting member which can be pulled out to the equipment main body and then the above described group of replenishing hoppers are fixed to the front of the above described supporting member, and the group of replenishing hoppers are installed and removed integrally with the group of the developing devices according to pulling out and inserting of the supporting member from and to the equipment main body, thereby intending simplification of structure and operation.

The above second object to provide an image developing device in which the developing agent cartridge is installed for replenishing hoppers arranged in a row in the lateral direction, the replenishing port can be opened and closed without being hindered by an adjacent replenishing hopper and the toner can be replenished easily is attained by an image developing device provided with multiple toner replenishing devices respectively on the periphery of a light-sensitive drum in which the top surface of the said toner replenishing device is a replenishing port to enable the lid to be opened sideways and which are arranged with a difference in level from each other.

BRIEF DESCRIPTION OF THE DRAWINGS

FIG. 2 is a sectional view of a developing device used for the above described device.

DETAILED DESCRIPTION OF THE INVENTION

Figure 1:
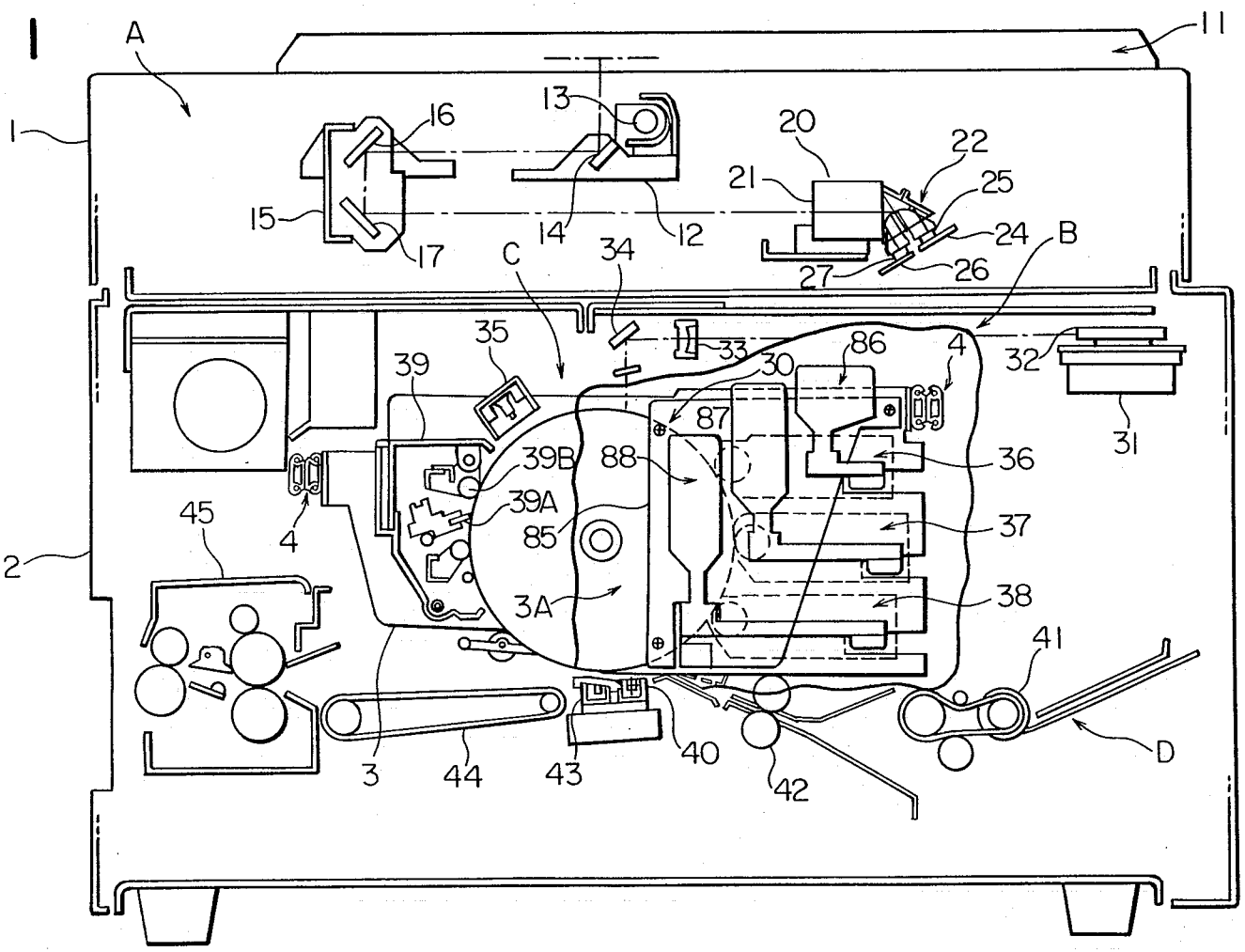
FIG. 1 is a sectional view of a multicolor image developing device according to this invention.

FIG. 1 shows the major composition of the multicolor image developing device in which A is an image reading system, B is units of a laser writing system, C is an image formation unit, and D is a paper supply unit. Color image is formed in the following process:

In the above described reading system A, the numeral 11 is an original copy stand. Original copy on the said stand 11 is lighted by a halogen lamp 13 installed to the carriage 12 sliding in the horizontal direction. Movable mirror unit 15 is provided with mirror 16 and 17, it also slides also horizontally, is combined with mirror 14 installed to the above described carriage 12, and leads the light image of the original copy to the lens reading unit 20.

The above described carriage 12 and above described movable mirror unit 15 are driven through wire connected to the stepping motor (both not illustrated) and slide in the same direction at speeds of V and ½V respectively. The above described lens reading unit 20 is composed of lens 21, prism 22, No. 1 reading board 24, red channel (R-ch) CCD25, No. 2 reading board 26, and cian channel (C-ch) CCD27.

The light image of the original copy transmitted by above described mirror 14, 16, and 17 is converged by above described lens 21, separated to R-ch image and C-ch image by the dichroic mirror provided in prism 22, and the image is formed on the light receiving surface of R-ch CCD25 provided on No. 1 reading board 24 and C-ch CCD27 provided on No. 2 reading board 26 respectively.

The image signal output from the above described R-ch CCD25 and C-ch CCD27 is processed in the signal processing unit. In the signal processing unit, the color signal which is color-separated according to the toner color is output and input to the above described laser writing system unit B which is an exposure means.

In the laser writing system unit B, laser beam generated by a semi-conductor laser (not illustrated) is rotated and scanned by the polygon mirror 32 which is rotated by driving motor 31, its optical path is bent by mirror 34 through F0 lens 33, projected on the peripheral surface of image carrier 30 which is impressed with electric charge by charging device 35.

On the other hand, when scanning is started, the beam is detected by the index sensor, beam modulation by No. 1 color signal is started, and modulated beam scans the peripheral surface of above described image carrier 30. Therefore latent image corresponding to the No. 1 color is formed on the peripheral surface of image carrier 30 by the primary scanning by the laser beam and secondary scanning by rotation of image carrier 30. This latent image is developed by developing device 36 charged with red toner (image revealing medium), for instance, among developing means and toner image is formed on the drum surface. The toner image obtained passes below cleaning device 39 which is a cleaning means separated from the peripheral surface of image carrier 30 while being held to the drum surface and enters the next copy cycle. In other words, image carrier 30 is charged again by charger 35, then No. 2 color signal output from the signal processing unit is input to the above described writing system unit B, writing to the drum surface is conducted in the same way as in the No. 1 color signal, and a latent image is formed. The latent image is developed by developing device 37 charged with blue toner, for instance, as the second color. The blue toner image is formed over the above described red toner image which is already formed.

The numeral 38 is a developing device containing black toner. Black toner image is formed on the drum surface according to the control signal generated by a signal processing unit. AC and DC bias is applied to the sleeve of these developing devices 36, 37, and 38, jumping development is conducted by 2-component developing agent, and non-contact development is conducted for grounded image carrier 30.

Color image formed on the periphery of image carrier 30 in this way is transferred to recording paper, a recording medium, sent from the above described paper supply unit D through paper supply belt 41 and paper supply roller 42 at transfer pole 40 provided as a transfer means. The recording paper on which toner image is transferred is separated from the drum surface by separating pole 43 and fed to fixing device 45 through carrier belt 44 in which the image is fixed.

On the other hand, blade 39 A of the above described cleaning device 39 comes in contact with image carrier 30 after the recording paper is separated from the drum periphery to remove the remaining toner and is separated from the drum periphery surface again upon completion of cleaning, and a new color image formation process is started.

The layout of the major component units described above is described below. As shown in FIG. 1, the image reading system A described above is contained in independent specific-use cabinet 1 and placed over main body 2, which is described later, and installed to it.

An image recording system comprising the above described writing system B, image formation unit C, paper supply unit D, and others is incorporated in the above described main body 2 and receives color signal from the above described image reading system A through a group of flexible cables connected to cabinet 1.

Image carrier 30 is positioned at the approximate center of above described main body 2, above described developing devices 36, 37, and 38 are disposed horizontally facing its right periphery surface, and above described charging device 35 and above described cleaning device 39 are disposed on the left periphery surface.

The above described image carrier 30, developing devices 36, 37, and 38, and cleaning device 39 are installed with bearings or removably to supporting member 3 which is removably incorporated to main body 2.

Figure 3:
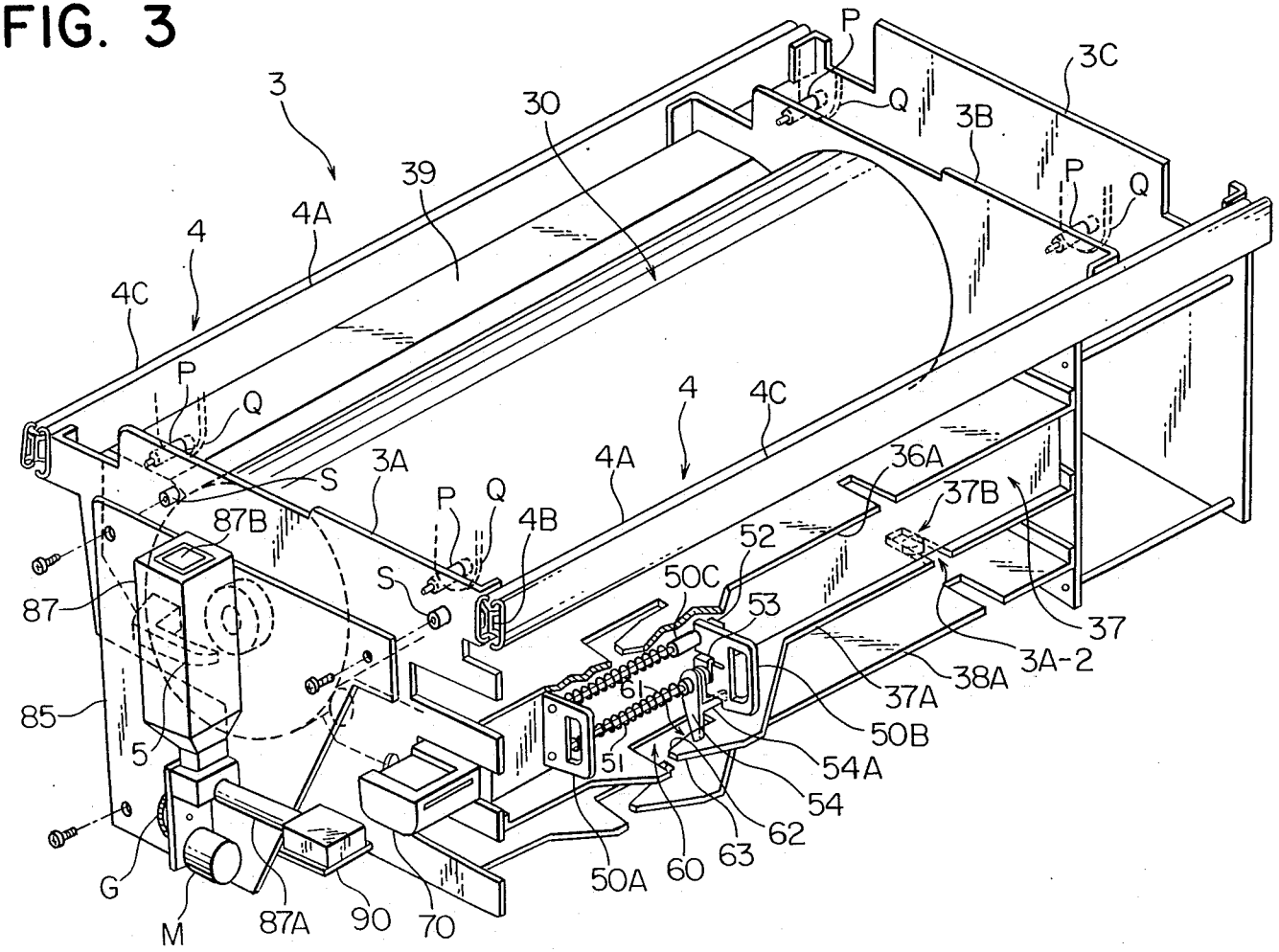
FIGS. 3 and 5 are oblique projection drawings of the above described device.

The above described supporting member 3 is composed of 3 panels 3A, 3B, and 3C which are similar to each other and integrally fixed to each other through stay or others as shown in FIG. 3, and can be easily removed from or installed to the main body 2 by a pair of right and left guide member 4 composed of multiple balls and rails. Rail 4A is fixed to the right and left side edge of above-described supporting member 3 and rail 4C is fixed to the position of the main body 2 corresponding to said rail 4A. They are linked with rail 4B through multiple balls respectively to form a slidable pair.

A pair of reference pins P are installed respectively on the right and left sides near the top side edge at the back of above described panels 3A and 3B, and above described image carrier 30, developing devices 36, 37, and 38, and cleaning device 39 installed to supporting member 3 are suspended by linking the reference pins to the hole of the suspending part Q derived from the front and back boards fixed to the main body 2 and the position of said image carrier 30, developing devices 36, 37, and 38, and cleaning device 39 with respect to main body 2 is determined at this condition.

Therefore, when grip 5 on the front of panel 3A is pulled, the above described supporting member 3 is pulled out for a long distance frontward of main body 2 by the rolling action of the balls with above described rail 4B as the relay member, and by pushing in above described grip 5, above described reference pin P is inserted into the hole of above described suspending part Q so that above described supporting member 3 is suspended again and enhoused in main body 2.

By such a structure to hold above described supporting member 3 by suspending to the board of main body 2, vibration or shock transmitted from the motor or others installed to main body 2 to above described image carrier 30, developing devices, or cleaning device are remarkably relieved and absorbed, and even if some vibration or shock is transmitted, members receive them uniformly. For instance, since multiple developing devices and light-sensitive drums are in a held relatively even condition and therefore the vibration or shock does not interfere with image formation remarkably.

Especially adverse influence of vibration, impact, etc. on the delicate press-fit, pressure-contact, weighting, and other conditions when second cleaning roller 39B or others are separated or brought in contact under pressure in order to dispose remaining toner from the cleaning device of the overlapping developing image formation type after blade 39A or cleaning blade are released is remarkably released and absorbed, by holding image carrier 30 and cleaning device 39 integrally to the supporting member 3. Such effects are the same when combination of the reference pins P on the panel 3A and 3B and holes of the suspending part A to be fitted to the main body are exchanged. The panel board may be composed of 2 front and back boards and 3 panel composition of this embodiment is not always necessary.

In the case of the image formation process by placing one upon another as described above, above described image carrier 30 requires peripheral length corresponding to a page of B4 or A3 form, which is the largest recording body, plus some allowance and the outside diameter should be about 130ϕmm to 150ϕmm. In this embodiment, a light-sensitive drum of 150ϕmm is used.

As for developing devices 36, 37, and 38, for which details are described later, it became possible to reduce the outside diameter of the developing sleeve to 20ϕmm without deteriorating the image performance and restrict the thickness (height) of each developing device to less than 40ϕmm sufficiently. As a result, in order to cope with color application, it became possible to arrange 3 to 4 developing devices (that is, developing devices 36, 37, and 38 in this embodiment) piling them up horizontally within space corresponding to the range of the outside diameter dimension of above described image carrier 30. Therefore it is possible for above described supporting member 3 to enhouse all of the multiple developing devices 36, 37 and 38, not to mention above described cleaning device 39, even though the height is limited to the minimum dimension required to cover the image carrier 30 in order not to give influence on the layout of members directly fixed to main body 2, especially upper laser writing system B, lower transfer pole 40, separation pole 43, and other members of the conveyance system, and thereby the conveyance path of the recording paper can be composed approximately on a straight line. It is effective to prevent a jam also and, even though a jam occurs, its disposal is easy.

Above described developing devices 36, 37, and 38 composed as follows are used:

In this embodiment, developing devices 36, 37, and 38 have the same structure, which is described below referring to the sectional view of the developing device 37 in FIG. 2-*a*.

The numeral 370 is a housing, 371 a developing sleeve, 372 a magnetic roll, 373 a developing agent layer forming plate, 374 a supply roller, 375 a developing agent layer peeling off plate, 376A and 376B a stirring screw, and 377 a stirring partition provided between stirring screw 376A and 376B.

Developing sleeve 371 in housing 370 of about 40 mm in thickness is a stainless steel cylinder with blast-treated 3 μm surface. It rotates clockwise at a speed of 200–300 r.p.m. and carries developing agent in the direction indicted by the arrow to the developing area.

Magnetic roll 372 is a magnet body with 12 minus 1 SN poles provided alternately as shown in FIG. 2-b and fixed to the inside of developing sleeve 371 for development. Magnetic roll 372 is fixed in this actual example but may be a rotating one. The point of fixed magnetic roll 372 from which one magnetic pole is excluded is the repellent magnetic field. At the point of developing sleeve 371 corresponding to this point, developing agent layer peeling off plate 375 is provided to peel off developing agent after completing development by passing through the developing area.

Supply roller 374 is a sponge roller rotating clockwise without contacing developing sleeve 371. New toner stirred by the rotation of stirring screws 376A and 376B is supplied and supply roller 374 supplies stirred developing agent quickly and uniformly to developing sleeve 371.

The new developing agent is attached to developing sleeve 371 and carried, and the thickness of the developing agent attached to developing sleeve 371 and carried is controlled by developing agent layer forming plate 373 positioned on the downstream side of the sleeve. Developing agent layer forming plate 373 is an elastic thin plate fixed at one end, made of phosphor bronze of 0.1 mm in thickness and urethane rubber of 0.5 mm in thickness bonded to each other, and in sliding contact with the periphery surface of developing sleeve 371 under light pushing force and developing sleeve 371 carries developing agent which is controlled to a thin layer to the developing area. The quantity of the developing agent on developing sleeve 371 is controlled to about 6–8 mg/cm$^2$. The developing gap in the developing area is held at about 0.5 mm for non-contact development. Developing bias applied to developing sleeve 371 here is −500 V DC bias superimposed with AC bias of 4 KHz at 700 rmsV. The developing bias applied to each developing sleeve is supplied from a power source unit in the equipment main body through a connector which is connected at the time when the developing device is installed in the equipment main body 2, the mechanism of which is described later.

When the above conditions are satisfied in the developing area, toner is effectively supplied from the thin developing agent layer on developing sleeve 371 towards the latent image surface on the image carrier. The above described developing agent layer is a very thin layer (10 μm−450 μm) as described above and therefore non-contact development with a gap between the image carrier and developing sleeve 371, that is the developing gap, as small as 500 μm is possible. Such a small developing gap is advantageous since the electric field of the developing area becomes larger so that sufficient development is attained with low developing bias voltage applied to developing sleeve 371 and leak discharge of developing bias, etc. is reduced. In addition, the resolving power of an image obtained by the development and other image quality are generally improved. The allowable range of the developing gap is 500±300 μm in the case of this developing method and desirably 500±150 μm. There are many restrictions in practical use and less variation is desired. For instance, a developing gap of 500±±50 μm is very desirable and should be maintained for the color duplicator of this invention. The integral structure of this invention is advantageous in this respect also. The developing method by a very thin developing agent layer as described above exhibits remarkable effect in a developing device of a small diameter sleeve, for instance. The developing gap of about 1 mm was required before when conducting non-contact development with a small diameter sleeve less than about 30 mm, for instance, since the developing agent layer thickness is difficult to control. For this reason, high DC bias voltage was required, resolving power, gradation reproducibility and general image quality of an image obtained by development were reduced, and specifically details such as characters were not reproduced sufficiently, or special considerations were necessary such as restricted materials or sizing, etc.

On the contrary, according to the developing method with the developing device described above, a very thin developing agent layer is formed for development and resultantly the developing gap is small, the electric field is sufficiently large, and the resolving power, gradation reproducibility and other image quality of the image developed are remarkably improved Since a small diameter sleeve is possible, an expensive developing device becomes small in size reducing the cost, arrangement of image forming equipment for color electrophotography which requires many developing devices becomes easier, and the entire equipment becomes compact.

Another effect of the developing method described above is that scattering of small particles (5 μm to 100 μm in size) of carrier or toner can be reduced. Formerly, when developing using a developing agent composed of small-sized particles of carrier and toner, the above described carrier and/or toner was scattered staining the inside of equipment, toner of different color entered the developing device containing color toner disturbing the color balance of the image, fogging was generated, and there were various other problems Such problems are remarkably reduced by the developing method described above.

Still another effect is that, owing to the non-contact developing method and since only toner selectively flies towards the latent image for development, fogging of the toner or attachment of the carrier to the latent image, which often is caused in solarization using an image forming body having organic light-sensitve layer especially, is avoided In addition, since the latent image surface is not scrubbed, the image formation body surface is not damaged or a brushing mark is not formed, revolving power and gradation reproducibility are high, and sufficient volume of toner can be attached to the latent image surface Furthermore, since developing on the image formation body on which toner image is formed is possible, it is suitable to the multicolor development by the multicolor image developing device according to this invention.

The above described developing devices 36, 37, and 38 are installed to supporting member 3 as shown in FIG. 3 so as to be installed and removed easily by the installing mechanism as described later.

When above described developing devices 36, 37, and 38 are installed to supporting member 3 and enhoused in device main body 2, developing device 37 forms specified developing gap Dsd as described above to the drum peripheral surface with its developing sleeve 371 placed on the horizontal surface passing through the axis of light-sensitive drum 30 as shown in FIG. 2-*b* and developing devices 36 and 38 are disposed so as to compose developing areas with specified Dsd respectively placing each developing sleeve 361 and 381 on the position on the drum peripheral surface in such positional relation as to make a central angle of 30° respectively above and below the horizontal surface passing through the axis of light sensitive drum 30.

Therefore, even though developing devices 36, 37, and 38 commonly use the magnetic rolls 362, 372 and 382 with the same magnetic pole phase, magnetic roll 362 and 382 of developing devices 36 and 38 can dispose the S pole normally respectively adjacent to the above described N pole when magnetic roll 372 of developing device 37 disposes the N pole normally to the peripheral surface of light-sensitive drum 30.

In other words, by installing developing devices 36, 37, and 38 at each position on the drum peripheral surface so that the center angle between developing sleeves 361, 371, and 381 is the same as the center angle between the magnetic poles of magnetic rolls 362, 372, and 382 when viewed from the axis of the sensitive drum 30, it becomes possible for the roll main body to use the magnetic rolls 362, 372, and 382 in common including the installing specification for the developing device. Therefore, when the magnetic rolls of 10 magnetic poles are used, for instance, each developing device is installed so that each developing sleeve faces at a position on the drum pheripheral surface at central angle of 36° respectively to the drum axis.

The central angle, between developing sleeves when viewed from the drum axis, being integer times to the central angle between magnetic poles of the magnetic roll also causes adjacent magnetic poles to face normally and the object of this invention is attained.

This invention composes so that the central angle viewed from the drum center at the position where the light-sensitive drum and developing sleeve are opposed is the same as or the integer times to the central angle viewed from the roll center between the magnetic poles of the magnetic rolls, thereby intending to provide a developing device under such a condition that the magnetic pole faces normally the light-sensitive drum without necessity of adjusting the phase of the magnetic pole of the magnetic roll at all.

By the above composition, to commonly use magnetic rolls having the same roll body and the same magnetic pole phase for each developing device disposed along the rotating direction of the light-sensitive drum becomes possible. In the results, manufacturing expense of the developing devices can be reduced and image developing devices, which are very advantageous with respect to service and maintenance due to common parts and advantageous practical use, can be provided.

Next, the installing mechanism to install the developing devices 36, 37, and 38 to supporting member 3 or remove them from supporting member 3 is described below. A case of the developing device 37 is described below referring to FIG. 3. At the back of developing device 37, a pair of upper and lower guide pins 51 with a compression spring inserted on the outside are installed between the fixed grip 50A and holding piece 52, and bias the movable grip 50B slidablly inserted around the above described guide pin 51 to the right.

The movable grip 50B is fitted with and supported by the guide pin 51 through a pair of upper and lower boss 50C and a push lever 54 biased counterclockwise by torsion spring 53 is installed axially to lower boss 50C. On the other hand, guide plate 37A enhousing developing device 37 is fixed to the supporting member 3 and at the side end of the guide plate 37A corresponding to the push lever 54 hook-shaped notch 60 is provided.

When the developing device 37 is installed to the supporting member 3, the push lever 54 is in contact with the linear part 61 of the notch 60 and pushed slightly clockwise, and its reaction force pushes developing device 37 towards image carrier 30 keeping the gap (Dsd) between the image carrying surface and developing sleeve at a specified value (for instance, a structure to push a roller provided on the concentric circle with the developing sleeve against the light sensitive drum to keep the gap (not illustrated)).

To remove developing device 37 from supporting member 3, by sliding the movable grip 50B left against the action of the compression spring, the push lever 54 reaches incline part 62, starts to return counterclockwise, and during that process, projection 54A is brought in contact with movable grip 50B and stops. Therefore by holding the fixed grip 50A and the movable grip 50B at the position where the boss 50C touches the fixed grip 50A and pulling them, the push lever 54 can get out of the opening of the notch 60 thereby the developing device 37 is taken out and separated from supporting member 3.

To install it to supporting member 3, by placing the front end of developing device 37 on the guide plate 37A and inserting pin 37B provided at the bottom of developing device 37 so as to be fitted into groove 3A-2 provided in the above described panel 3A, the push lever 54 can be inserted into the opening of the notch 60. Then, by sliding the movable grip 50B to the right end of the guide pin 51, by the action of the compression spring the push lever 54 comes in contact with incline part 63 and slides together with the movable handle 50B along the guide pin 51 by that inclination angle.

After the push lever 54 is inserted into the opening of notch 60, the movable grip 50B further slides to right by the action of the compression spring, the push lever 54 reaches the linear part 61 and is slightly rotated clockwise, thereby the above described condition to bias developing device 37 is effected. Developing devices 36 and 38 are installed to and removed from supporting member 3 by the same installing mechanism.

Furthermore, to install developing devices 36, 37, and 38, a foolproof mechanism by specifications of length, depth, and width or relative position, single or multiple combinations of mechanical elements which are combinations of groove, hole, notch, etc. and dowel, rail, or other projections, and a fitting mechanism by selection of the specifications described above has been employed. For instance, the horizontal position where the above described pin 37B and groove 3A-2 are fitted varies depending on types of developing devices to prevent installation of other types of developing devices. On the other hand, replenishing hoppers 86, 87, and 88 which are replenishing means prepared to replenish toner to the developing devices 36, 37, and 38 are installed and held to hopper installing plate 85 with the shape as shown in FIG. 3 directly fixed to the panel 3A composing the front of the supporting member 3.

The replenishing hoppers 86, 87, and 88 respectively contain red, blue and black toner and are fixed to the hopper mounting plate 86 to hold specific positions respectively in the lateral direction viewed from the front of the equipment main body as shown in FIG. 1. Connection and separation of replenishing hopper 87 to developing device 37, and the mechanism of connection and separation of the replenishing port are described below. The replenishing hopper 87 has at the bottom toner carrying unit 87A incorporating a carriage screw which is rotated and driven through gear system G from the motor M and blue toner is replenished from toner replenishing member 90 provided at the end of said toner carrying unit 87A to the above described developing device 37. FIG. 3 shows a developed view of the hopper mounting plate 85 installed to supporting member 3. After the replenishing hopper 87 and not illustrated replenishing hoppers 86 and 88 are installed and held to hopper mounting plate 85, a multiple number of spacers S are installed with snap screws beforehand to the supporting member 3 to which none of the developing devices has been installed.

When developing device 37 is installed to supporting member 3 in the procedure described above at this condition, toner replenishing member 70 provided and projecting on the side of developing device 37 projects from the notch of the panel 3A and is fitted to toner replenishing member 90 of the replenishing hopper 87 connecting both replenishing ports.

Figure 4:
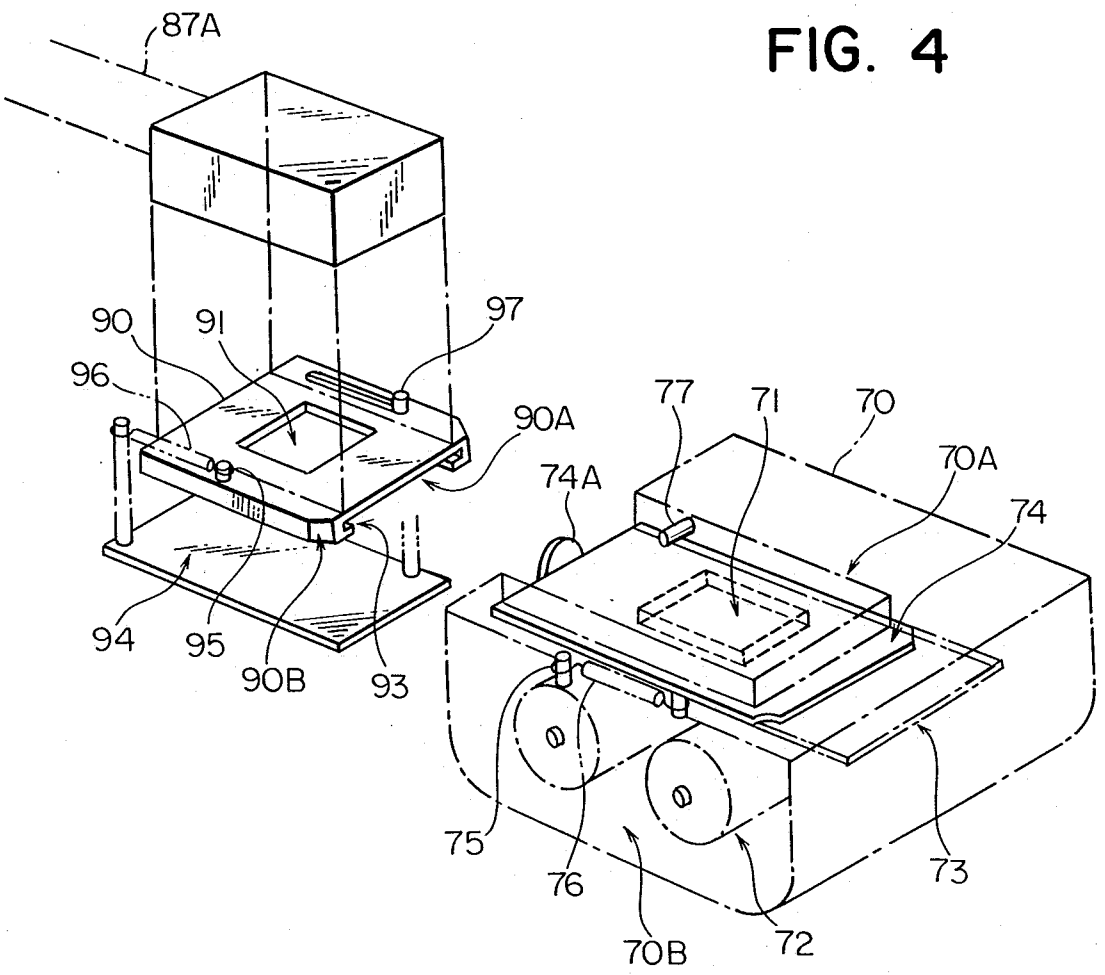
FIG. 4 is developed oblique projection drawing of the above described developing device and toner replenishing unit of the replenishing hopper corresponding to it.

FIG. 4 shows a developed view of the composition of toner replenishing member 70 which each developing device has and toner replenishing member 90 which each replenishing hopper has.

The toner replenishing member 70 is a hollow vessel with square-recessed part 70A including replenishing port 71 opened on the top and semi-cylindrical space 70B to contain toner carrying screw 72 at the bottom. It functions to carry the toner replenished from the replenishing port 71 to developing device 37 by rotation of the toner carrying screw 72.

Slit 73 is formed from both sides of the recess part extending over the one outer side surface of toner replenishing member 70 and thin plate-shape shutter plate 74 is fitted by sliding to said slit 73.

The shutter plate 74 is propelled left by the action of tension spring 76 stretched between it and the pin 75 fixed to toner replenishing member 70, and is in contact with the stopper (not illustrated) at the position shown in the figure covering the replenishing port 71 and is stopped.

On the other hand, the toner replenishing member 90 is a frame-like member with width to be fitted to the recess part 70A of the toner replenishing member 70 and having replenishing port 91 opened at its approximate center and fixed integrally to the end of the toner carrying unit 87A.

At the bottom of the toner replenishing member 90, slit 93 is formed and thin shutter plate 94 is fitted by sliding to said slit 93.

The shutter 94 is biased to the right by the action of tension spring 96 stretched between shutter 94 and pin 95 fixed to toner replenishing member 90, and is in contact with the stopper (not illustrated) at the position as shown in the figure covering the replenishing port 91 and stopped.

Therefore, when developing device 37 is pulled out from supporting member 3, both replenishing ports 71 and 91 of each toner replenishing unit are covered by each shutter plate and leakage of toner and entry of dust are completely prevented by this mechanism.

When developing device 37 is placed on the guide plate 37A and inserted inward to install it to supporting member 3, the recess part 70A of the toner replenishing member 70 comes in contact with and fitted with tapered part 90B which determines the position at the time of fitting considering allowance to said toner replenishing member 90 at the time of being fitted to the developing device respectively corresponding to multiple replenishing members, and claw 74A of shutter plate 74 comes in contact with its front edge 90A.

Therefore the above described shutter plate 74 slides right resisting the action of tension spring 76 in response to insertion of developing device 37 opening the above described replenishing port 71. Slightly later than it, pin 77 on the side wall of the recess part 70A comes in contact with pin 97 of shutter plate 94 after passing through toner replenishing member 90, and said shutter plate 94 slides left resisting the action of tension spring 96 begging to open the replenishing port 91. The replenishing ports 71 and 91 are opened as developing device 37 is installed and when developing device 37 is installed completely to the specified position of supporting member 3, the replenishing port 71 completely agrees with the replenishing port 91 to allow the toner in replenishing hopper 87 to drop and flow in. Replenishing ports 71 and 91 are opened as developing device 37 is installed as described above. Replenishing port 71 is slightly larger than replenishing port 91 and in addition, since it is designed so that replenishing port 91 starts to be opened slightly later than replenishing port 71, leakage of toner apt to be caused at the time of connection can be prevented.

Connection of each developing device and each replenishing hopper is attained in this way and replenishing toner from each replenishing hopper becomes possible. On the other hand, the toner replenishing member 70 can be automatically separated from the toner replenishing member 90 without allowing toner leakage also by the action to pull out developing device 37 from supporting member 3. That is, by pulling out the developing device 37 from supporting member 3, said pin 77 is retracted starting to release the pushing action against said shutter plate 94, said shutter plate 74 starts to be released from the pushing action against front edge 90A of toner replenishing member 90 slightly later, and therefore replenishing port 71 is kept open constantly larger than replenishing port 91 as at the time of installation, the lid is closed gradually, and replenishing port 71 is automatically closed again as shown in FIG. 4 upon separation of said toner replenishing member 70 from toner replenishing member 90. In the above description, opening/closing lids are used for both sides but the opening/closing lids may be used for only one side depending on their disposition, opening/closing method, or other conditions.

Figure 6:
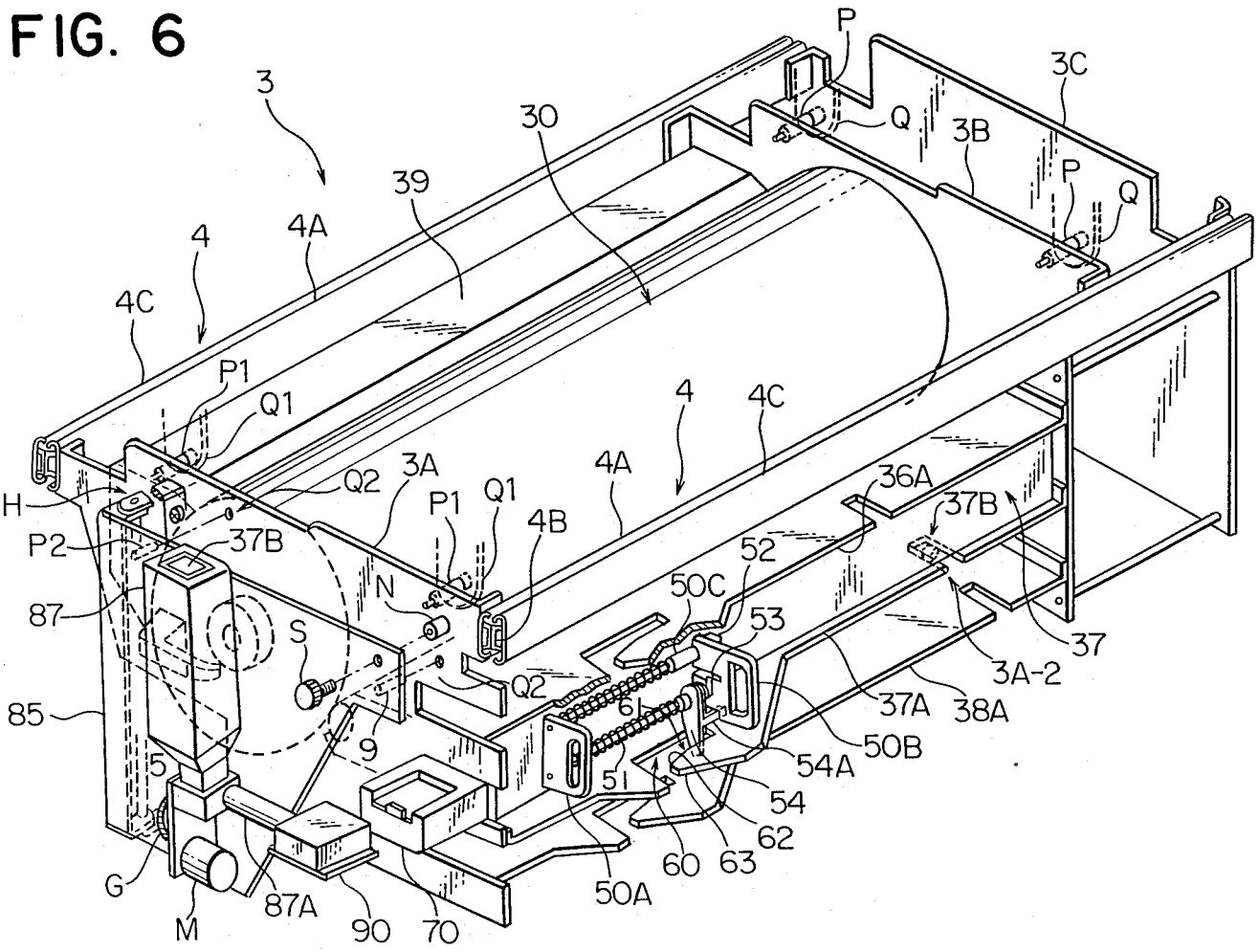
FIGS. 6 and 7 show another embodiment regarding installation of the above described developing device and replenishing hopper.
Figure 7:
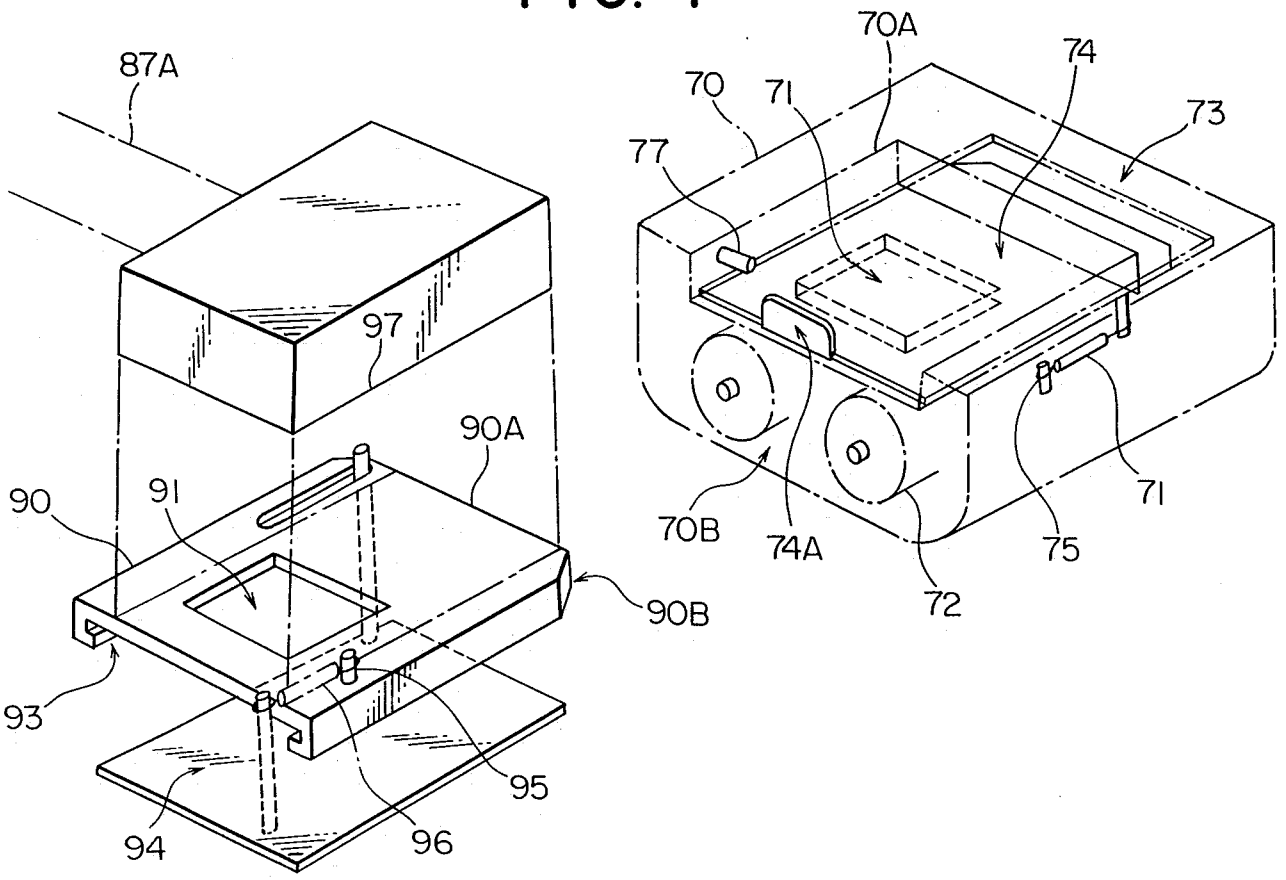

Another actual example of installation of the replenishing hopper and developing device is described below referring to FIGS. 6 and 7. In FIGS. 6 and 7, members having the same function as those in FIGS. 3 and 4 are given the same numbers.

FIG. 6 is a developed view of said hopper mounting plate 85 which is closed against supporting member 3. Said replenishing hopper 87 and replenishing hoppers 86 and 88 (not illustrated) are installed to and held by said hopper mounting plate 85, said hopper mounting plate 85 is rotated counterclockwise with the hinge H as the fulcrum, a pair of reference pins P2 are inserted and fitted to reference hole Q2 provided on panel 3A thereby controlling the position of said hopper mounting 85 with respect to each developing device, and then passed through the hole of hopper mounting plate 85 and clamped by the tightening screw S which is tightened to the nut N on panel 3A. In this actual example, developing device 37 and developing devices 36 and 38 (not illustrated) have been already mounted to supporting member 3 before the hopper mounting plate 85 is closed and clamped in the procedure described above By the closing and clamping actions of the hopper mounting plate 85 to supporting member 3, toner replenishing unit 90 of each replenishing hopper and toner replenishing unit 70 of each developing device are connected with each other and their replenishing inlets are automatically interconnected.

FIG. 7 is a developed view of toner replenishing 70 of each developing device and toner replenishing unit 90 of each replenishing hopper.

The toner replenishing member 70 is a hollow vessel with square recess part 70A with replenishing port 71 opened on the top and semi-cylrindrical space 70B to incorporate screw 72 for transferring the toner at the bottom and functions to transfer toner replenished from the replenishing inlet 71 to developing device 37 by rotation of the toner transfer screw 72. Slit 73 is formed from both side surfaces of the recess part extending to the outside surface of toner replenishing unit 70 on one side and thin shutter plate 74 is fitted by sliding to the slit 73.

The shutter plate 74 is propelled left by the action of tension spring 76 stretched between pin 75 fixed to toner replenishing unit 70 and shutter plate 74 and at the position in the figure to have covered the replenishing port 71, it is in contact with the stopper (not illustrated) and stopped by it.

The toner replenishing member 90 is a frame-shaped member with width to be fitted with recess part 70A of the toner replenishing member 70 and replenishing port 91 at the approximate center and fixed integrally to the end of the toner transfer unit 87A.

Slit 93 is formed on the bottom surface of the toner replenishing member 90 and thin shutter plate 94 is fitted by sliding to said slit 93.

The shutter 94 is propelled left by the action of tension spring 96 stretched between the shutter 94 and pin 95 fixed to toner replenishing member 90 and in contact with the stopper (not illustrated) and stopped by it at the position in the figure to have covered the replenishing port 91.

Therefore, when hopper mounting plate 85 is rotated clockwise to open the front of supporting member 3, both replenishing ports 71 and 91 of each toner replenishing member are closed by each shutter plate and leakage of toner and mixture of dust are completely prevented. When the hopper mounting plate 85 is rotated counterclockwise and mounted to supporting member 3 to close it, tapered part 90B for positioning at the time of interconnection is brought in contact and fitted with recess part 70A of toner replenishing member 70 giving consideration to allowance and play when the toner replenishing member 90 is interconnected with developing devices corresponding to each one of multiple replenishing members and its front edge 90A is brought in contact with claw 74A of shutter plate 74.

The shutter plate 74 slides right against the action of tension spring 76 and opens the replenishing port 71 when hopper mounting plate 85 is installed. Slightly later, pin 97 of shutter plate 94 after passing through toner replenishing member 90 comes in contact with pin 77 on the side wall of recess part 70A and said shutter plate 94 slides left against the action of tension spring 96 and starts to open the replenishing port 91.

The replenishing ports 71 and 91 are opened progressively with the closing action of hopper mounting plate 85 and, when hopper mounting plate 85 is completely mounted to the specified position of supporting member 3, the replenishing port 71 completely agrees with replenishing port 91 to allow drop and flow in of toner in replenishing hopper 87.

Replenishing ports 71 and 91 are opened as described above according to the closing action of hopper mounting plate 85. Replenishing port 71 is opened slightly larger than replenishing port 91 and in addition, since it is designed so that replenishing port 91 starts to open slightly later than replenishing port 71, toner leakage which is apt to occur at the time of connection can be prevented also. Connection between toner replenishing ports of each developing device and each replenishing hopper is attained in this way to allow replenishment of toner from each replenishing hopper, while the action of hopper mounting plate 85 to be released from supporting member 3 also enables the toner replenishing member 70 to be separated from toner replenishing member 90 automatically without causing toner leakage.

That is, when the hopper mounting plate 85 is rotated clockwise to be released from supporting member 3, the pin 97 is retracted from pin 77, starts to release the push action against the shutter plate 94, and slightly later, the shutter plate 74 starts to be released from the pressure-fitting action given by front edge 90A of toner replenishing member 90. Therefore replenishing port 71 is closed keeping the opening constantly larger than replenishing port 91 as at the time of installation. It automatically becomes the closing condition as shown in FIG. 7 again upon separation of toner replenishing member 70 from toner replenishing member 90.

Figure 5:
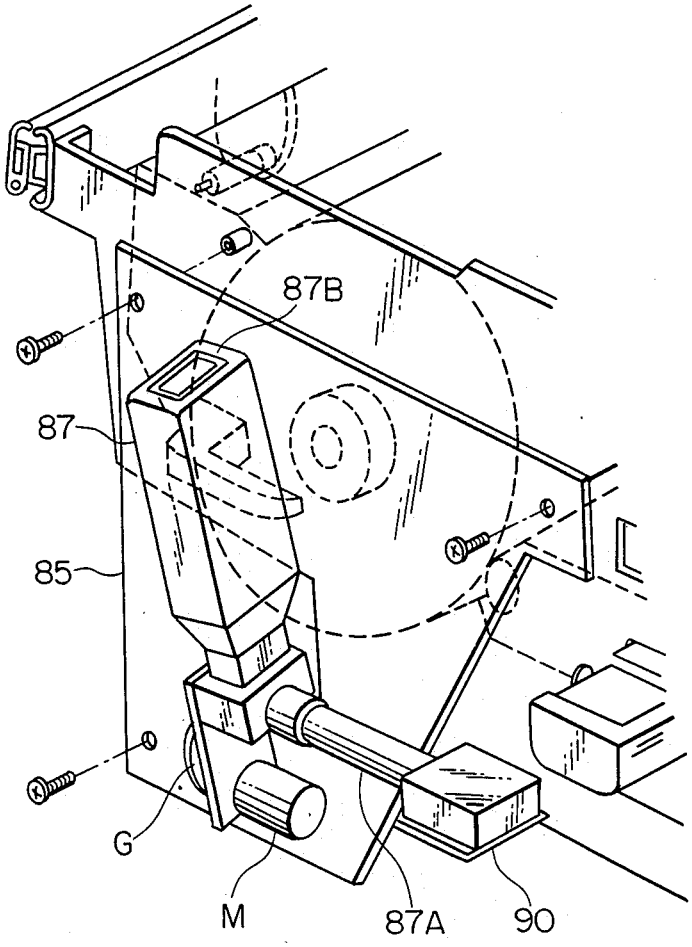

In the above actual example, toner is replenished to the replenishing hopper 87 from the outside of the equipment by installing a developing agent cartridge containing a specific color, blue in this case, to installing part 87B at the top of replenishing hopper 87. The installing part 87B is designed not to allow a developing agent cartridge containing toner other than blue to be installed and prevents red or black toner from being replenished to the developing device 37 by mistake. This design is applied also to the replenishing hoppers 86 and 88. Each replenishing hopper is designed to be inclined frontwards at a specified angle at the relay portion of toner transfer unit 87A as shown in FIG. 5, thereby facilitating installation and removal of the developing agent cartridge.

In the above actual example, a multicolor image developing device of the non-contact, multiple-rotation, overlapping type is described but the multiple rotation overlapping image formation method is not necessarily required. It has been confirmed that a favorable image can be obtained by the contact type developing method owing to the compact developing device and no particular form of actual example is required from the intent of this invention.

For instance, various forms of multicolor image developing devices comprising multiple developing devices whether they are of the monocolor type provided with such a contact/separation structure that keeps multiple developing devices separated from the image carrier while not operating and keeps them in contact while operating, a multicolor type, contact/non-contact developing method as described above, a jump developing type using AC bias which is used generally, or other developing methods shall be included in the intention of this invention if they are automatically connected with or separated from multiple replenishing hoppers by installing or removing developing devices, or if multiple developing devices mounted to a supporting member by a foolproof mechanism are inevitably connected with multiple replenishing hoppers by a foolproof mechanism.

This invention enables installation of the major component members to the main body of the device or remove them from it by a very simple operation by incorporating major component members including the image carrier, each developing means and cleaning means of the image recording system as a unit to a supporting member independent from the equipment main body. In addition, this invention enables installation of the replenishing means of each developing agent to be connected to each of the developing means to the front in the inside of a device which has sufficient space, is composed easily, and is convenient for replenishing developing agent, cleaning, inspecting, etc., from the outside of the device.

The result is a multicolor image developing device which is highly advantageous with respect to operation such as prevention of damage to the image carrier, prevention of color mixture apt to occur when installing or removing the developing device, and others as well as having a simpler and more compact structure.

Figure 8:
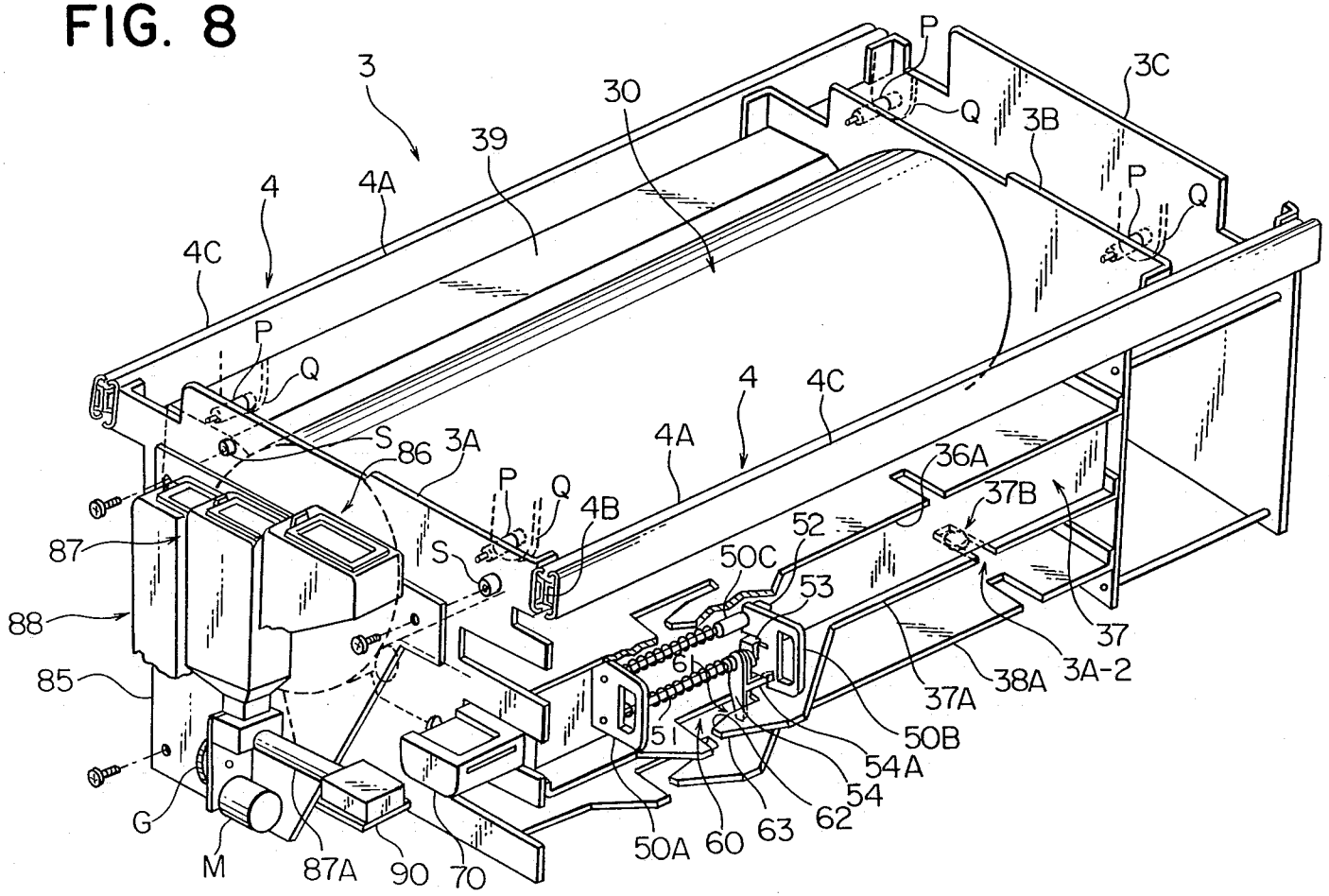
FIGS. 8 and 9 are developed oblique projection drawings showing the connection structure of the replenishing hopper and the developing agent cartridge in the above described developing device.
Figure 9:
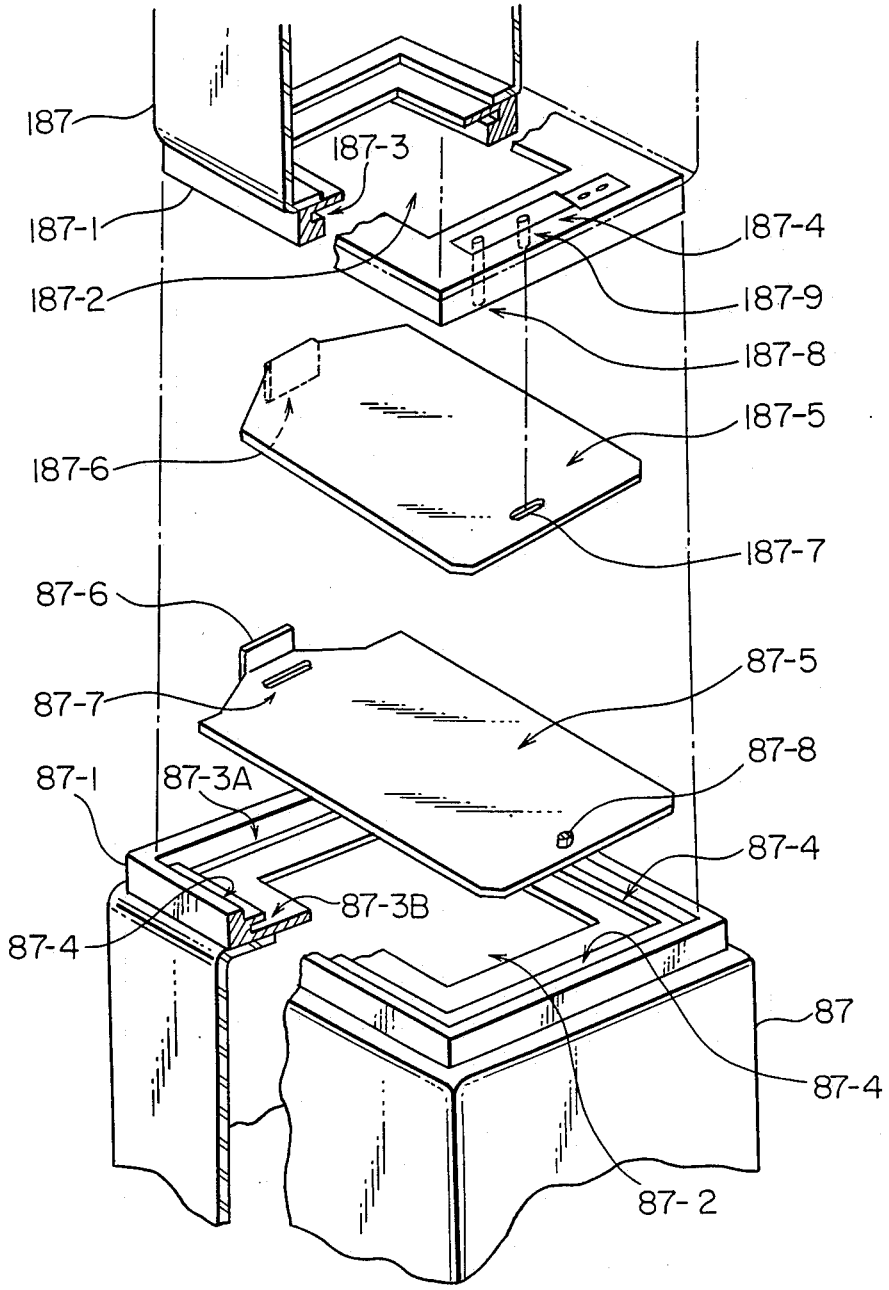
Figure 10:
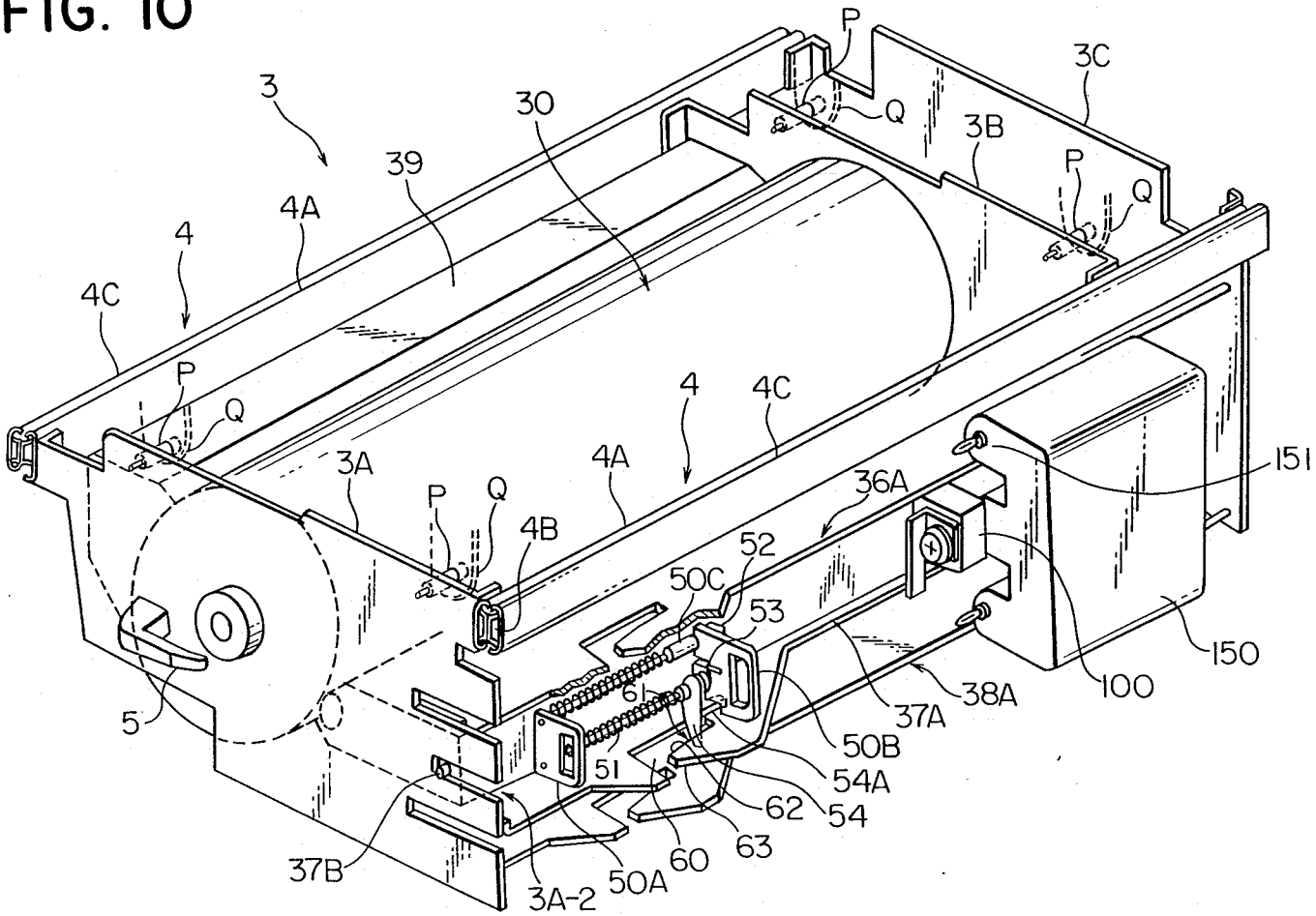
FIGS. 10 and 11 are perspective views representing a mechanism for supplying developing bias to each developing devices.

Another actual example desirable in this invention about toner supplement to replenishing hoppers which is the second object is described below referring to FIGS. 8 and 9.

Each hopper is provided with a toner replenishing port on the top surface of the vessel main body to which a developing agent cartridge is installed to receive replenishment of toner of a specific color respectively. FIG. 9 is a developed view of the connection structure between the replenishing hopper 87 and corresponding developing agent cartridge 187 containing toner of a specific color, that is, blue.

Toner replenishing port 87-2 is opened at the center of the top surface of the vessel main body of the replenishing hopper 87, frame-shaped connecting member 87-1 with stepped part 87-4 formed on 3 sides around the port is fixed and thin shutter plate 87-5 inserted from the outside through the slit 87-3A is inserted into the slit 87-3B on 3 sides formed below the part 87-4 covering the toner replenishing port 87-2.

The shutter plate 87-5 is slided left, that is to the replenishing hopper 88 side in FIG. 1, through grip 87-6 projecting to the outside of slit 87-3 and, since replenishing hoppers are disposed lower with steps in the left direction as described above, toner replenishing port 87-2 is opened by pulling out the shutter plate 87-5 easily without obstruction. Shutter plate 87-5 causes pin 87-8 to touch the inside of the connecting member 87-1 to lock when being pulled out.

Toner replenishing port 187-2 is opened at the center of the bottom surface of the vessel main body of the developing agent cartridge 187 connecting member 187-1 with contour to be fitted with stepped part 87-4 of the connecting member 87-1, and thin shutter plate 187-5 is inserted into slit 187-3 on 3 sides formed on the inside of the connecting member 187-1 inserted from the outside through the slit (not illustrated) passing through the right side of connecting member 187-1 as in the replenishing hopper 87, covering the toner replenishing port 187-2.

When connecting member 187-1 on the side of developing agent cartridge 187 is fitted with stepped part 87-4 of connecting member 87-1 on the side of replenishing hopper 87, trailing part 187-6 of shutter plate 187-5 on the side of developing agent cartridge 187 is interconnected with long hole 87-7 on shutter plate 87-5 and at the same time push pin 187-8 fixed to leaf spring 187-4 on the inside of the connecting member 187-1 with the end projecting on the bottom surface of connecting member 187-1 is pushed in when touching the stepped part 87-4.

As the result, stop pin 187-9 of the leaf spring 187-4 which is interconnected with long hole 187-7 of the shutter plate 187-5 and the locks the shutter plate 187-5 retracts upwards, is separated from long hole 187-7, and unlocks the shutter plate 187-5.

Therefore, when the shutter plate 87-5 of replenishing hopper 87 is pulled out to the right by grip 87-6 and toner replenishing port 87-2 is opened, the shutter plate 187-5 of replenishing agent cartridge 187 is also pulled out to the right at the same time to open toner replenish port 187-2, and toner contained in it drops and is supplemented to replenishing hopper 87.

After completion of replenishment, as soon as the shutter plate 87-5 is pushed in covering toner replenishing port 87-2 again, the shutter plate 187-5 is also pushed in covering toner replenishing port 187-2, separated from replenishing hopper 87 thereby interconnecting the stop pin 187-9 with the long hole 187-7 again to prevent unnecessary opening of toner replenishing port 187-2. In this actual example, the structure to connect developing agent cartridge 187 to replenishing hopper 87 is described. A specific developing agent cartridge is selected and connected respectively with the replenishing hoppers 86 and 88 by the same connecting structure. This invention enables installation and removal of the major component members to and from the equipment main body by a very simple operation by incorporating major component members including the image carrier, each developing means and cleaning means of the image recording system as a unit to the supporting member independent from the equipment main body and disposes each replenishing hopper to be connected with the developing means on the front of the supporting member easy to incorporate, so as to be convenient to connect with the developing agent cartridge and supplement developing agent to the replenishing hopper. The result is an image developing device for which usual cleaning and inspection as well as supplementing developing agent are very easy. Next, the mechanism to supply developing bias to each developing device is described.

Each developing device is provided with connector 100 to connect developing bias power source at the positions arranged in parallel with the above described grips 50A and 50B at their back respectively. When the above described supporting member 3 is inserted from the device front in parallel with the equipment main body 2 guided by guide member 4 and installed, the jack which is the supply-receiving part incorporated in the connector 100 causes plug 151 of power source 150 on the equipment main body 2 side to be inserted, and current of specified developing bias is supplied to the developing sleeve 371 of each developing device by the connection.

Figure 11:
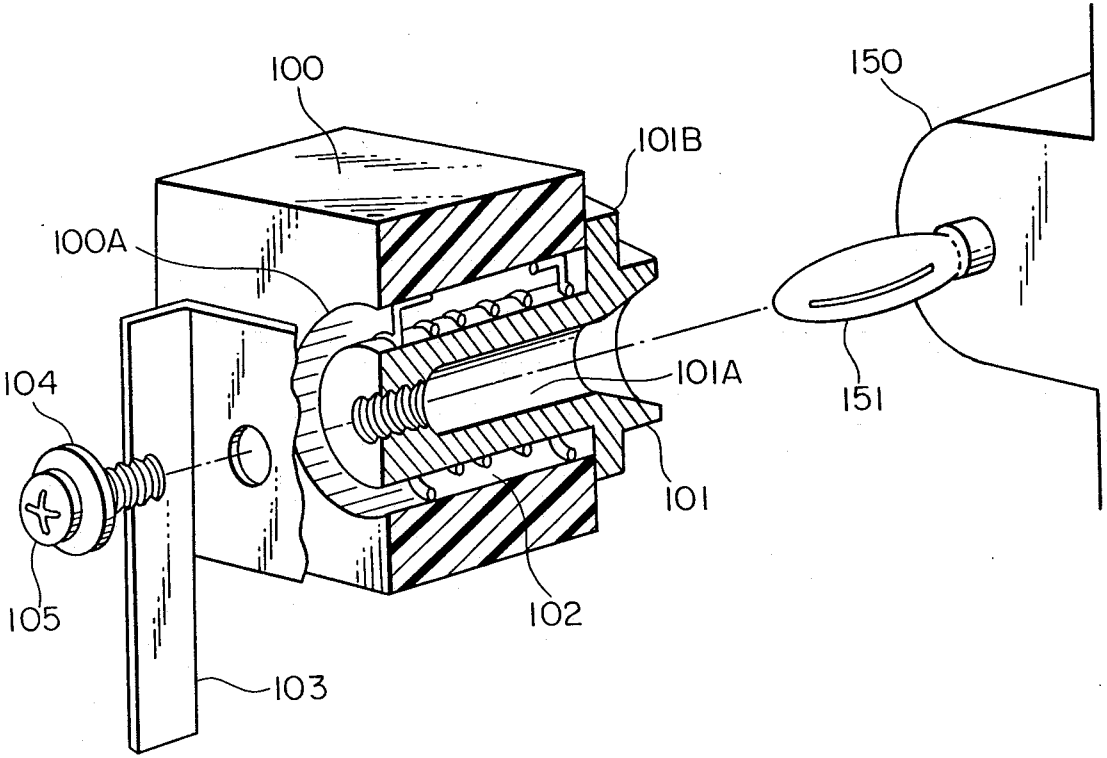

In FIG. 11, the connector 100 is developed and a section of that major part is shown. The jack 101 connecting plug 151 of power source unit 150 is enhoused in through hole 101A of connector 100 formed of electric insulating material and supported by coil spring 102 inscribed in the through hole 101A, and held at a suspended condition at a position to align the through hole 101A and axis. That is, the coil spring 102 is a deformed compression spring with coil diameter at both ends larger and the diameter of multiple coils in the middle smaller, holding the jack 101 approximately at the axis center by the middle coils.

Connecting hole 101A with tapered part to enable connection with the plug 151 and absorb offset of the center at the right end is opened in the jack 101 and at the left end, tightening screw 105 is threaded in with washer 104 integrally inserting terminal board 103 to be connected with developing sleeve 371 between them. The gap between flange 101B of the above described jack 101 and the terminal board 103 is set slightly larger than the thickness of connector 100 and supported so that the jack 101 can be offset in parallel with the axis resisting elasticity of coil spring 102 without axial displacement. Therefore, as described above, even when slight play or variation occurs in the guide member 4 to guide supporting member 3 or in the positions to enhouse each developing device, when installing the supporting member 3 to device main body 2, the tapered part of the connecting hole 101A touches the end of plug 151 of power source unit 150 first and resultantly the jack 101 aligns keeping the axis in parallel against elastic action of coil spring 102 and therefore, even if installation of supporting member 3 is continued at this condition, the jack 101 causes the plug 151 to be inserted without force and can connect connector 100 to power source unit 150 safely and positively. In this actual example, only developing device 37 is described. Developing devices 36 and 38 are also connected with power source unit 150 of equipment main body 2 with a similar connector 100 and supplies current of developing bias to developing sleeve respectively. By the above composition, connecting the developing bias power source from the device main body to the developing devices at the same time as the developing device installation operation became possible and resultantly operation for connecting the power source becomes unnecessary, providing an image developing device which is useful, simple to operate and has high durability.

What is claimed is:

1. An apparatus for forming a color image on an image carrier which is rotatable about its axis in a rotation direction, said apparatus comprising, an exposure device adapted to form a latent image on said image carrier, a plurality of developing devices, each of said plurality of developing devices adapted to form a color toner image and having a toner replenishing device, a transfer device for transferring said color toner image from said image carrier to a copy paper, a housing member for housing at least said image carrier, said plurality of developing devices and said replenishing devices as a single unit, and a guide member for guiding said housing member whereby said housing member is movable in a direction parallel to said axis, thereby permitting attachment and detachment of said unit to and from said apparatus, wherein said toner replenishing devices are mounted at one end of said housing member.

2. The apparatus of claim 1 wherein each of said replenishing devices comprises a hopper for storing toner and a connecting member between said hopper and a predetermined one of said developing devices, whereby said toner is fed from said hopper to said predetermined one of said developing devices through said connecting member.

3. The apparatus of claim 2 wherein said toner replenishing devices are attached to a plate member which is pivotally mounted on one side of said housing member, and each said connecting member is coupled to said developing devices through pivotal motion of said plate member.

4. The apparatus of claim 2 wherein each said hopper is vertically attached to a corresponding connecting member and pivotally supported by said corresponding connecting member, and each said hopper is inclined to said connecting member when receiving fresh toner therein.

5. The apparatus of claim 3 wherein respective top levels of each said hopper are stepped relative to each other.

6. The apparatus of claim 4 wherein a top of each said hopper comprises an opening for receiving fresh toner.

7. The apparatus of claim 5 wherein a top of each said hopper comprises an opening for receiving fresh toner and a shutter member for shutting said opening, and said shutter member is slidably mounted movable to a next lower hopper.

8. The apparatus of claim 1 wherein each of said developing devices has an electric connector, and said electric connector is coupled with a bias source on said housing member when said unit is attached to said apparatus.

9. The apparatus of claim 1 wherein said toner replenishing devices are mounted on a front side of said housing member.

10. The apparatus of claim 3 wherein said plate member is pivotally mounted on a front side of said housing member.

* * * * *